US007942353B2

(12) United States Patent
Cerra et al.

(10) Patent No.: US 7,942,353 B2
(45) Date of Patent: May 17, 2011

(54) ADJUSTABLE SCREEN FOR MATERIAL DESTRUCTION APPARATUS

(75) Inventors: Richard D. Cerra, Acme, PA (US); Andrew J. Ciesielski, Greensburg, PA (US); Stephen H. Ciesielski, Slickville, PA (US); James J. Wagner, Manor, PA (US); Thomas A. Wagner, Export, PA (US)

(73) Assignee: Allegheny Paper Shredders Corporation, Delmont, PA (US)

( * ) Notice: Subject to any disclaimer, the term of this patent is extended or adjusted under 35 U.S.C. 154(b) by 477 days.

(21) Appl. No.: 11/784,008

(22) Filed: Apr. 5, 2007

(65) Prior Publication Data

US 2008/0099591 A1 May 1, 2008

Related U.S. Application Data

(60) Provisional application No. 60/854,608, filed on Oct. 26, 2006.

(51) Int. Cl.

| | |
|---|---|
| ***B02C 13/00*** | (2006.01) |
| ***B02C 17/02*** | (2006.01) |
| ***B02C 9/04*** | (2006.01) |
| ***B07B 13/00*** | (2006.01) |
| ***B07C 7/00*** | (2006.01) |

(52) U.S. Cl. .... 241/73; 241/89.1; 241/89.2; 241/101.72

(58) Field of Classification Search ..... 241/189.1, 241/73, 89.1, 89.2, 101.741, 101.72
See application file for complete search history.

(56) References Cited

U.S. PATENT DOCUMENTS

| | | | | |
|---|---|---|---|---|
| 121,192 | A | | 11/1871 | Page |
| 879,440 | A | | 2/1908 | Carothers |
| 1,133,421 | A | | 3/1915 | Aspinwall et al. |
| 1,523,614 | A | | 1/1925 | Shelton |
| 1,595,685 | A | | 8/1926 | Parini |
| 1,847,193 | A | * | 3/1932 | Peters ..... 241/89.1 |
| 2,315,651 | A | | 4/1943 | Peterson |
| 2,360,357 | A | | 10/1944 | Marshall |
| 2,440,927 | A | * | 5/1948 | Boss et al. ..... 241/89.2 |
| 2,520,718 | A | | 8/1950 | Hanson |
| 2,597,333 | A | * | 5/1952 | Vaclav Jindrich ..... 241/88.3 |
| 2,640,650 | A | * | 6/1953 | Jacobson ..... 241/89.2 |
| 2,661,159 | A | * | 12/1953 | Thomas ..... 241/89.2 |
| 2,669,396 | A | * | 2/1954 | Nickle ..... 241/89.2 |
| 2,732,137 | A | * | 1/1956 | Fisher ..... 241/89.2 |
| 2,954,175 | A | * | 9/1960 | Humphrey et al. ..... 241/41 |
| 3,874,835 | A | | 4/1975 | Rossiter et al. |
| 3,944,147 | A | * | 3/1976 | Pletcher ..... 241/60 |
| 3,946,950 | A | * | 3/1976 | Graf ..... 241/18 |
| 3,973,890 | A | | 8/1976 | Porter et al. |
| 3,989,198 | A | * | 11/1976 | Blasko ..... 241/101.76 |
| 4,046,325 | A | | 9/1977 | Tucsok et al. |
| 4,133,489 | A | * | 1/1979 | Maillet ..... 241/89 |
| 4,836,457 | A | * | 6/1989 | Greiner ..... 241/73 |
| 5,950,940 | A | * | 9/1999 | Hoof et al. ..... 241/73 |
| 6,719,226 | B2 | * | 4/2004 | Rajewski ..... 241/30 |
| 7,198,213 | B2 | * | 4/2007 | Kolbet et al. ..... 241/101.741 |
| 2007/0063080 | A1 | * | 3/2007 | Evans et al. ..... 241/73 |

* cited by examiner

*Primary Examiner* — Bena Miller
(74) *Attorney, Agent, or Firm* — James Ray & Assoc

(57) ABSTRACT

An adjustable screen apparatus for a material destruction device includes a first stationary fixed member and a second member positioned in an operatively juxtaposed and nesting relationship for reciprocal movement relative to the first member, each having a predetermined plurality of openings which are disposed in a predetermined pattern. A guide system is provided for guiding the reciprocal movement of the second member relative to the first member. A power operated drive is coupled to a source of power and to the second member for reciprocally moving the second member between a first position wherein each opening in the second member substantially overlaps a respective opening in the first member for producing large size particles and a second position wherein each opening in the second member partially overlaps each of a pair of adjacently disposed openings in the first member for producing small size particles.

23 Claims, 4 Drawing Sheets

ADJUSTABLE SCREEN FOR MATERIAL DESTRUCTION APPARATUS

CROSS-REFERENCE TO RELATED APPLICATIONS

This application is related to and claims priority from Provisional Patent Application Ser. No. 60/854,608 filed Oct. 26, 2006. This application is, also, closely related to a Provisional Patent Application titled "Control System for Mobile Material Destruction System" being filed concurrently herewith. The teaching of such Provisional Patent Application is incorporated into this document by reference thereto.

FIELD OF THE INVENTION

The present invention relates, in general, to material destruction devices and, more particularly, this invention relates to an adjustable screen for a material grinder having the capability of being adjusted to form at least one of a different size and shape of cut particles.

BACKGROUND OF THE INVENTION

As is generally well known, users of material destruction devices such as grinders, shredders and hammer mills, or material destruction services employing such devices must consider equipment throughput capability as it directly affects the material destruction costs. A direct relationship between equipment throughput and material destruction costs exists, wherein the higher throughput, measured in pounds per hour, results in lower costs of material destruction.

However, the throughput is adversely affected by the cut or final particle size of destructed material wherein the smaller particle size results in decreased throughput. Lately, smaller particle size is required in destructing materials containing sensitive information, for example, computer disks and/or credit cards, due to increased security concerns and data theft. The cut particle size is determined by the size of openings formed within screens used on such devices and, more particularly, on grinders and hammer mills. Reduction of the screen opening sizes results in a reduced cut particle size.

Accordingly, customers of sensitive information have been willing to absorb higher costs of destructing the material containing such sensitive information. Oppositely, customers of non-sensitive materials which are to be simply recycled require larger opening sizes in order to increase throughput and reduce material destruction costs. Prior to the present invention, the screens presently in widespread use have openings of a fixed size requiring screen changeout to provide a different opening size and, even more particularly, to provide a different particle size.

The particle size is particularly important to operators of mobile destruction services that employ trucks containing material destruction devices who must change the screen depending on specific customer requirements. The effort to change the screen is complicated by the fact that the screen on such mobile trucks is located between the devices and the payload storage compartment of such truck. Specifically, in applications involving security material grinders, the fasteners holding the screen to the frame of such material grinder must be first removed from each side of the truck. Next, the protective screen cover is removed from the inside of the payload compartment and then the screen itself is removed from the material grinder. A reverse procedure is used to install the screen having openings of the desired size. Accordingly, the effort required to change the screen increases the downtime and further increases the material destruction costs.

Efforts have been made to reduce the need for replacing screens by providing an adjustable dual screen device consisting of a fixed and a movable screen member wherein the movable screen is manually adjusted to very the opening size. U.S. Pat. No. 2,954,175 issued to Humhrey et al, U.S. Pat. No. 2,315,651 issued to Peterson, U.S. Pat. No. 2,661,159 issued to Thomas, U.S. Pat. No. 2,440,927 issued to Boss et al; U.S. Pat. No. 2,520,718 issued to Hanson, U.S. Pat. No. 1,847,193 issued to Peters, U.S. Pat. No. 1,523,614 issued to Shelton U.S. Pat. No. 121,192 issued to Page and U.S. Pat. No. 1,133,421 issued to Terway disclose various manually adjustable dual screen devices.

However, the prior art type adjustable dual screen devices still require greater than desired effort to adjust the opening size and, therefore, have failed to gain wide acceptance in the material destruction industry and particularly in the mobile destruction services industry.

SUMMARY OF THE INVENTION

According to one embodiment, the present invention provides an adjustable screen apparatus in combination with at least one of a material grinder and a hammer mill having a housing and a rotor operatively mounted in such housing. The adjustable screen apparatus includes a first member which is fixed in a stationary manner adjacent an output side of such rotor and between opposed sides of such housing. The first member has a predetermined plurality of first openings having a first predetermined shape and which are disposed in a first predetermined pattern. A second member is positioned in an operatively juxtaposed and nesting relationship for a reciprocal movement relative to the first member. The second member has a predetermined plurality of second openings having a second predetermined shape and which are disposed in a second predetermined pattern. A guide means is provided for guiding the reciprocal movement of the second member relative to the first member. A power operated drive means is coupled to a source of power and to the second member for reciprocally moving the second member between a first position wherein each of the plurality of the second openings substantially overlaps a respective one of the plurality of the first openings for producing large size particles and a second position wherein the each of the plurality of the second openings partially overlaps each of a pair of adjacently disposed first openings for producing small size particles.

According to another embodiment of the invention, there is provided a material grinding apparatus. The material grinding apparatus includes a housing. A rotor is mounted for rotation adjacent one end of the housing. A first drive means is provided for rotating the rotor. An input chamber is formed in open communication with a top surface of the housing for receiving material to be ground. There is a means for biasing the received material toward the rotor. A screen means is positioned adjacent an output side of the rotor and between opposed sides of such housing. The screen means includes a stationary fixed member and a movable member which is disposed in an operatively juxtaposed and nesting relationship for reciprocal movement relative to the fixed member. Each member has a plurality of openings disposed in a predetermined pattern. A second drive means is coupled to a source of power and to the movable member for reciprocally moving the movable member between a first position wherein each opening in the movable member substantially overlaps a respective opening in a fixed member for producing large size particles and a second position wherein the each opening in the movable member partially overlaps each of a pair of adjacently disposed openings in the fixed member for producing small size particles. A control means is provided for operating each of the first drive means, the material biasing means and the second drive means.

According to yet another embodiment, the invention provides a mobile material destruction system. The system includes a vehicle which has a cab and a storage compartment for storing destructed material. A material destruction apparatus is provided for destructing the material and for delivering the destructed material into the storage compartment. A lift apparatus is operatively mounted adjacent the material destruction apparatus for delivering material to be destructed into an input chamber of the material destruction apparatus. A power operated adjustable screen means is provided for producing different size particles of the destructed material. The screen means has a stationary fixed member and a movable member which is disposed in an operatively juxtaposed and nesting relationship for reciprocal movement relative to the fixed member. Each member has a plurality of openings disposed in a predetermined pattern. The fixed and the movable members are positioned between an opening into the storage compartment and an output portion of the material destruction apparatus. A drive means is coupled to a source of power and to the movable member for moving the movable member between a first position wherein each opening in the movable member substantially overlaps a respective opening in a fixed member for producing large size particles and a second position wherein each opening in the movable member partially overlaps each of a pair of adjacently disposed openings in the fixed member for producing small size particles. A control means is mounted remotely from the screen means for selectively operating the drive means to reciprocally move the movable member between the first position and the second position.

OBJECTS OF THE INVENTION

It is, therefore, one of the primary objects of the present invention to provide an adjustable screen for a material destruction apparatus which can have an opening size change without having to change the screen.

Another object of the present invention is to provide an adjustable screen for a material destruction apparatus which can be retrofitted to existing material destruction apparatus.

Still another object of the present invention is to provide an adjustable screen for a material destruction apparatus which will exhibit a relatively long life.

Yet another object of the present invention is to provide an adjustable screen for a material destruction apparatus which is easy to use.

An additional another object of the present invention is to provide an adjustable screen for a material destruction apparatus which can be produced in a variety of sizes.

A further object of the present invention is to provide an adjustable screen for a material destruction apparatus which is remotely operable to change an opening size.

Another object of the present invention is to provide an adjustable screen for a mobile material destruction apparatus.

In addition to the various objects and advantages of the present invention which have been described above it should be noted that various additional objects and advantages of the present invention will become more readily apparent to those persons skilled in the relevant art from the following more detailed description, particularly, when such description is taken in conjunction with the attached drawing figures.

BRIEF DESCRIPTION OF THE DRAWING FIGURES

BRIEF DESCRIPTION OF THE INVENTION

Figure 1:
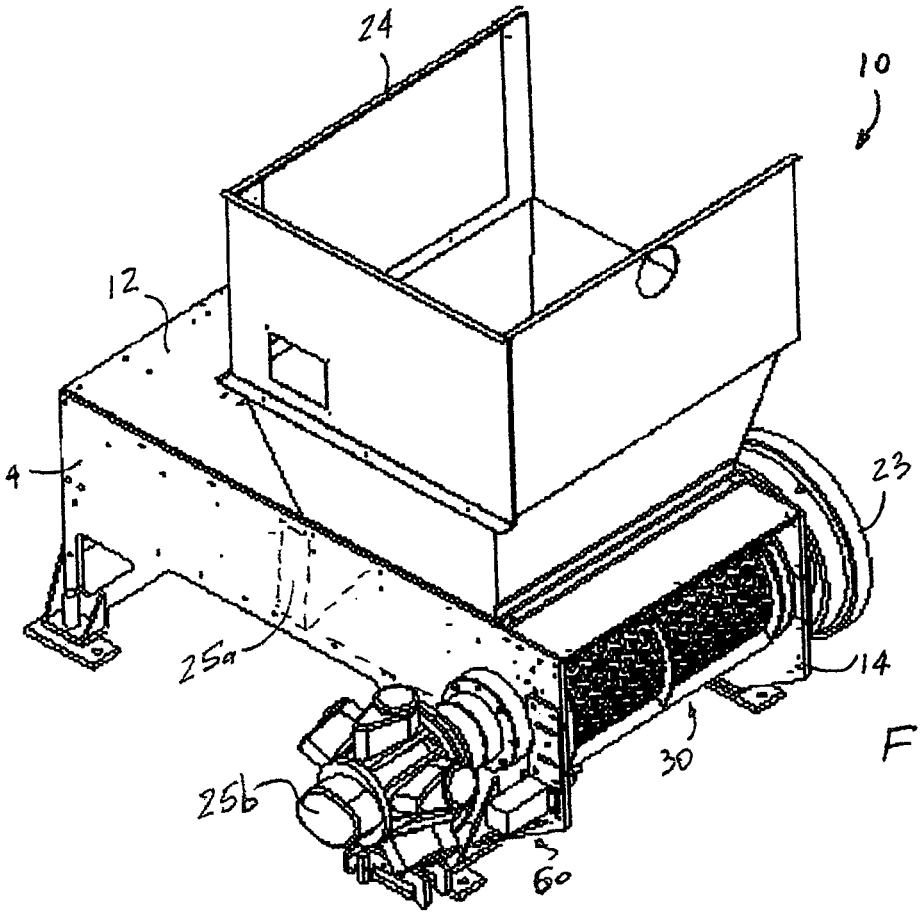
FIG. 1 is a perspective view showing one type of a material destruction apparatus, such as a material grinder, containing the adjustable screen of the present invention.

Prior to proceeding to the more detailed description of the present invention, it should be noted that, for the sake of clarity and understanding, identical components which have identical functions have been identified with identical reference numerals throughout the several views illustrated in the drawing figures.

The structure and operation of the adjustable screen of the present invention will be illustrated in combination with a single shaft rotary grinder of a type manufactured by Allegheny Paper Shredders Corporation of Delmont, Pa.

Figure 2:
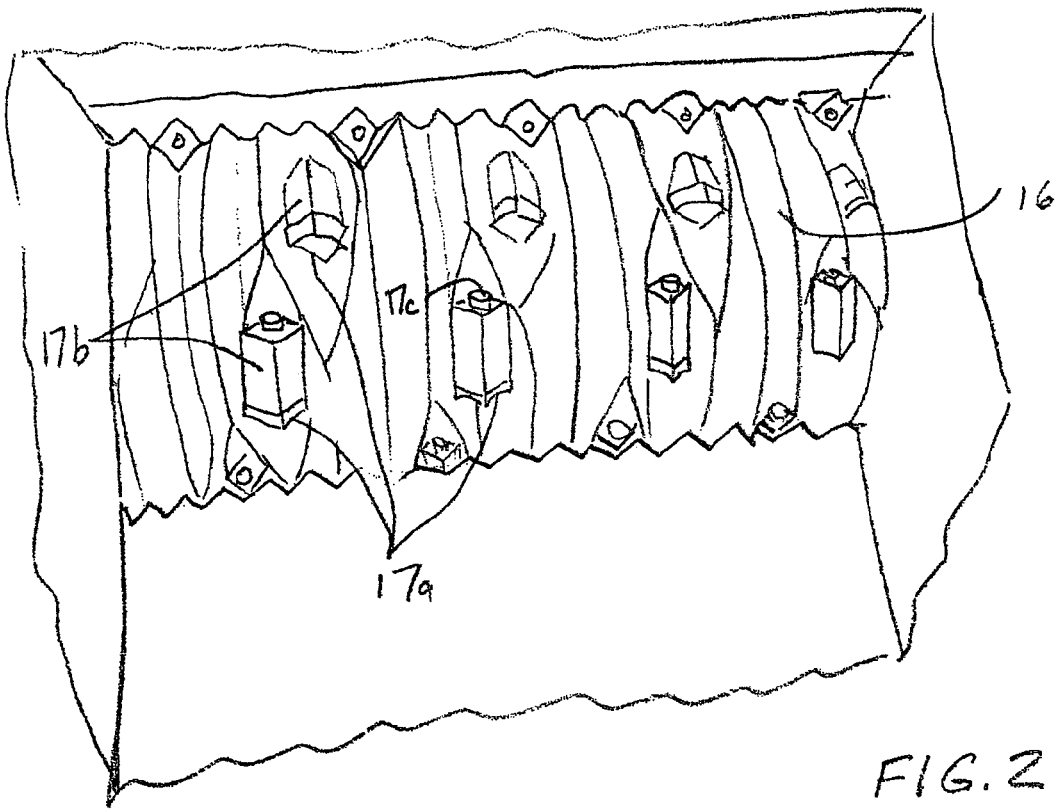
FIG. 2 is a partial perspective view showing a rotor of such material grinder of FIG. 1.

As illustrated in the attached drawing FIGS. 1-2, the single shaft rotary grinder, generally designated 10, includes a housing 12 having a pair of vertical side members 14. A material destruction member, such as rotor 16, is mounted for rotation adjacent one end of the housing. The rotor 16 has a plurality of cutting inserts 17*a* which are disposed in a staggered pattern, as best shown in FIG. 2. Each insert 17*a* is detachably attached to an insert block 17*b* with a fastener 17*c*. The block 17*b* is rigidly secured to the outer surface of the rotor 16, preferably by welding.

A first drive means 18 is provided to rotate the rotor 16. By way of example only, such first drive means 18 may include an electric motor 20 which is connected to the rotor 16 by way of belts 22 and a flywheel 23. An input chamber 24 is formed in open communication with a top surface of the housing 12 for receiving material (not shown) to be ground.

The material grinder 10 further includes a movable ram 25*a* for biasing the material (not shown) received in the input chamber 24 toward the rotor 16 and a second drive means 25*b*, such as a well known hydraulic motor, for reciprocally moving the ram 25*a*.

The adjustable screen means, generally designated 30, includes a pair of members 32 and 34 disposed in an operatively juxtaposed and nesting relationship for reciprocal movement to provide different size particles. Preferably, each member 32 and 34 is arcuately shaped and has each of a predetermined length and a predetermined radius. One of such pair of arcuately shaped members 32 and 34, preferably an inner member 32, is fixed to opposed sides 14 of such housing 12 adjacent an output side of such rotor 16 in a stationary manner.

Each of the arcuately shaped members 32 and 34 has a predetermined number of openings 36 and 38, respectively, formed therethrough and each such opening 36 and 38 has each of a predetermined size and a predetermined shape. Such predetermined size and predetermined shape of the openings 36 and 38 will depend on the type of material being ground and the end purpose for such material. It is not necessary for the openings 36 in the inner arcuately shaped member 32 to be the same as the openings 38 in the outer arcuately shaped member 34. It is further within the scope of the present invention for different size and shaped openings to be provided in the same arcuately shaped member 32 and 34.

Additionally, the predetermined shape of the openings 36 and 38 can be, for example only, round, rectangular, hexagonal, triangular, octagonal or any other geometric shape as desired.

Figure 3:
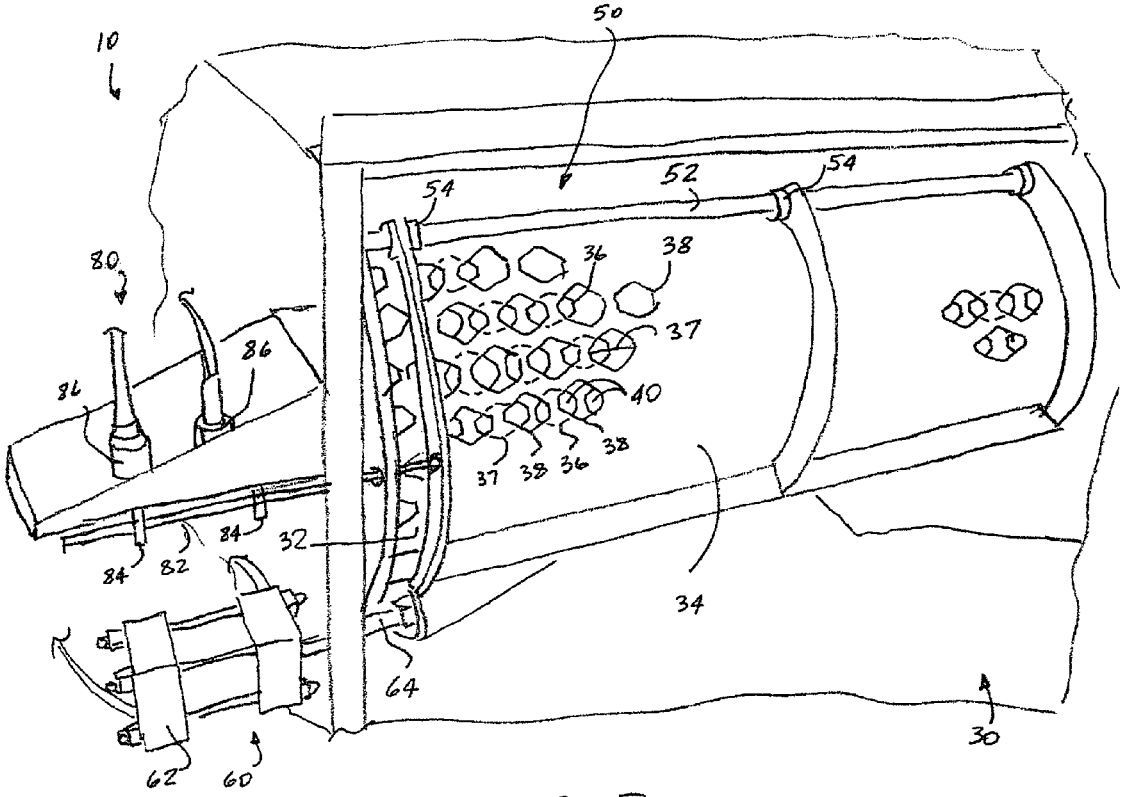
FIG. 3 is a partial perspective view showing the adjustable screen set at a position to provide small size particles and further showing one embodiment of the powered drive means.

It is presently preferred for each opening 36 and 38 to be substantially identical and to have a rhombus shape and further to have a longer diagonal 37 of the rhombus being disposed in a parallel relationship with a direction of reciprocal movement of the outer member 34 which is from left to right in FIG. 3.

A guide means, generally designated 50, is provided for guiding movement of the outer arcuately shaped member 34 relative to the fixed inner arcuately shaped member 32. In the presently preferred embodiment of the invention, such guide means 50 includes a pair of guide rails 52 which are positioned adjacent opposed edges of the inner arcuately shaped member 32 and which are attached thereto in a parallel relationship with each other.

A first pair of housings 54 are attached to annular portions 35 of the outer arcuately shaped member 34 adjacent one edge thereof and a second pair of housings 54 are attached to the annular portions 35 of the outer arcuately shaped member 34 adjacent an opposed edge thereof. Each housing 54 encases a respective one of the pair of guide rails 52 for guiding the movement of the outer arcuately shaped member 34.

Figure 4:
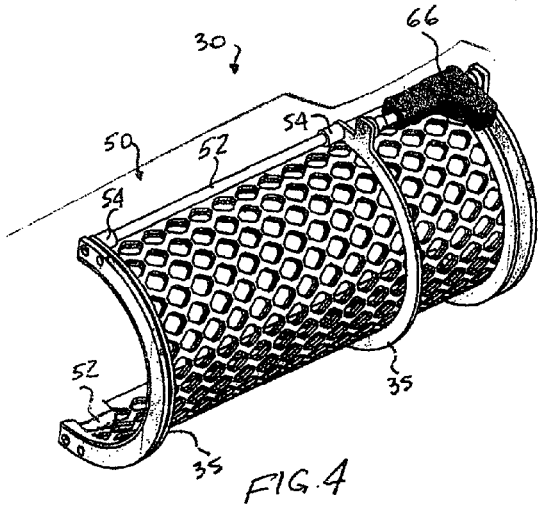
FIG. 4 is a perspective view showing the adjustable screen constructed according to the present invention set at a position to provide large size particles and further showing an alternative embodiment of the powered drive means.
Figure 5:
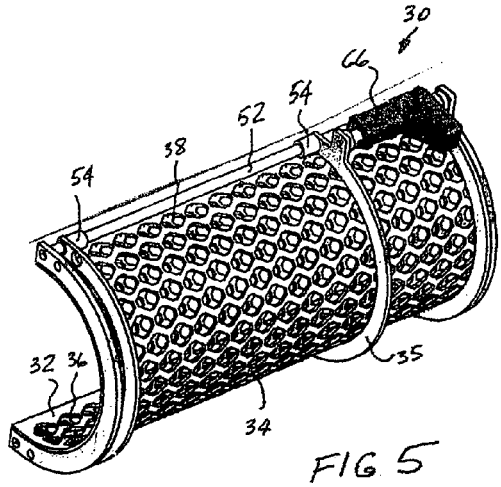
FIG. 5 is a perspective view showing the adjustable screen constructed according to the present invention set at a position to provide small size particles and further showing the alternative embodiment of the powered drive means.

A power operated drive means, generally designated 60, is coupled to a source of power 68 and to the outer arcuately shaped member 34, and provides for reciprocally moving such outer arcuately shaped member 34 between a first position, best shown in FIG. 4, wherein each of the plurality of openings 38 substantially overlaps a respective one of the plurality of openings 36 for producing large size particles and a second position, best shown in FIG. 5, wherein each of the plurality of openings 38 partially overlaps each of a pair of adjacently disposed openings 36 for producing small size particles.

In the presently preferred embodiment of the invention, such power operated drive means 60 includes an actuator 62 which is attached to one side of such housing 12 and is directly coupled to the outer arcuately shaped member 34. The actuator 62 can be powered by electrical, pneumatic or hydraulic power. Preferably, the actuator 62 is a hydraulic cylinder of a double acting type. Advantageously, the rod 64 of the hydraulic cylinder 62 is attached directly to the outer arcuately shaped member 34.

Alternatively, as best shown in FIGS. 4-5, the drive means 60 may include an actuator 66 which is attached to the inner arcuately shaped member 32 adjacent an exterior surface thereof and which is attached to the annular portion 35 of the outer arcuately shaped member 34.

Figure 6:
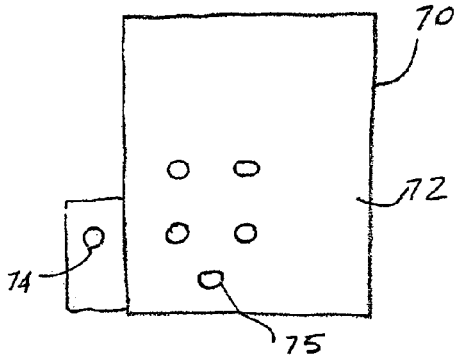
FIG. 6 is an elevation view showing the control apparatus constructed according to one embodiment of the invention.

The power operated drive means 60 is operable by a control means 70 which is preferably disposed remotely from the power operated drive means 60 and from the screen means 30. The control means 70 may be a simple switch means 74 which is mounted adjacent the control panel 72 of such rotary grinder 10, as best shown in FIG. 6, which is advantageous for retrofitting the screen means 30 into existing material grinding devices.

In operation, the cylinder 62 is selectively operable by remotely operable switch means 74 to reciprocally move such outer arcuately shaped member 34 between a first position wherein each of the plurality of the openings 38 substantially overlaps a respective one of the plurality of the openings 36 for producing large size particles and a second position wherein the each of the plurality of the openings 38 partially overlaps each of a pair of adjacently disposed openings 36 for producing small size particles.

Alternatively, the switch means 74, identified for the sake of clarity by reference numeral 75, is integrated directly into the control panel 72, which is advantageous for new material grinders 10.

Figure 7:
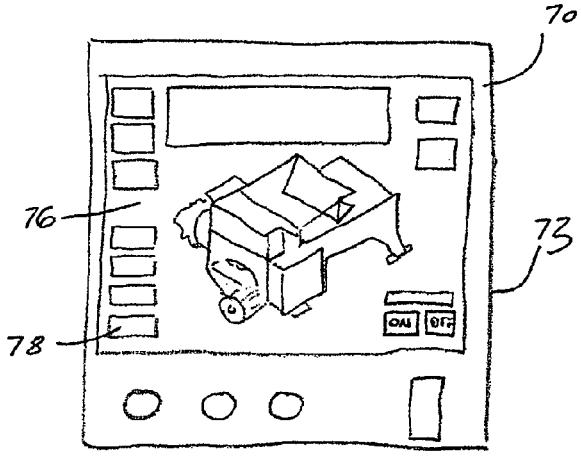
FIG. 7 is an elevation view showing the control apparatus constructed according to an alternative embodiment of the invention.

Alternatively, as best shown in FIG. 7, control means 70 may include a control panel 73 having a touch screen 76 which includes a switch mean portion 78 for operating the adjustable screen means 30.

It will be understood, that by employing power operated drive means 60, the duration of time required to change the configuration of the screen means 30 has been substantially minimized as compared with manually adjustable prior art type dual screen devices. Furthermore, the operator of such material grinder 10 does not have to possess mechanical skills in order to properly adjust dual screen devices.

The significance of the rhombus shape of the openings 36 and 38 is best shown in FIGS. 3 and 5, wherein openings 36 and 38 are illustrated as being in the second position for producing small size particles. Each opening 38 partially overlaps the corresponding opening 36 and further partially overlaps the adjacently positioned opening 36, identified by the reference numeral 37 for the sake of clarity. Such overlapping configuration produces a plurality of openings 40 within the screen means 30 which are similar in shape to but smaller in size than each opening 36 and 38.

Thus, while the area of each opening 40 has been found sufficient to produce small size particles, such rhombus shape has been found advantageous in minimizing linear dimensions of the opening 40 and preventing larger than desirable size particles to penetrate the screen means 30. Openings 36 and 37 being about 2 inches in length and about 1 inch in width and disposed in staggered patterns, as best shown in FIGS. 3-5, have been found advantageous producing both small and large size particles. Preferably, each corner of the opening 36 and 38 is adapted with a predetermined radius to improve exit of the ground material.

It is additionally within the scope of the present invention to incorporate a means, generally designated 80, for sensing the position of such outer arcuately shaped member 34. It is presently preferred for such sensing means 80 to include an elongated member 82 which is attached to the outer arcuately shaped member 34 for movement therewith, at least one target 84 which is rigidly mounted on the elongated member 82 and at least one sensor 86 attached to predetermined portion of the housing 12 for sensing presence of such at least one target 84 when the outer arcuately shaped member 34 is positioned in one of such first and such second position.

Preferably, a pair of targets 84 and a pair of sensors 86 are employed in the present invention to sense each first and second position of the outer arcuately shaped member 34 and to improve diagnostic capability of the screen means 30. The positional signal provided by each sensor 84 is received by the control means 70 and is used to monitor proper position of the screen means 30 and, more particularly, proper operation of the material grinder 10.

By way of an example only, when the switch means 74 is operable to move the outer arcuately shaped member 34 into the second position but a respective positional signal is not received by the control means 70, such control means 70 may discontinue operation of the material grinder 10 and activate an alarm (not shown) characterizing an undesirable failure condition of such material grinder 10. Alternatively, the sensing means 80 may be integrated into the cylinder 62.

Figure 9:
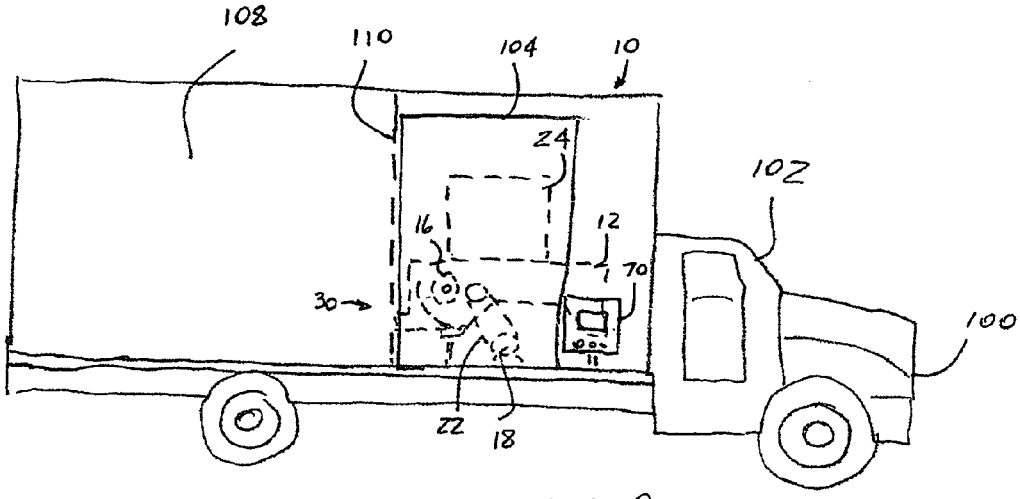
FIG. 9 is a schematic side elevation view showing the mobile material destruction system containing the adjustable screen of the present invention.
Figure 10:
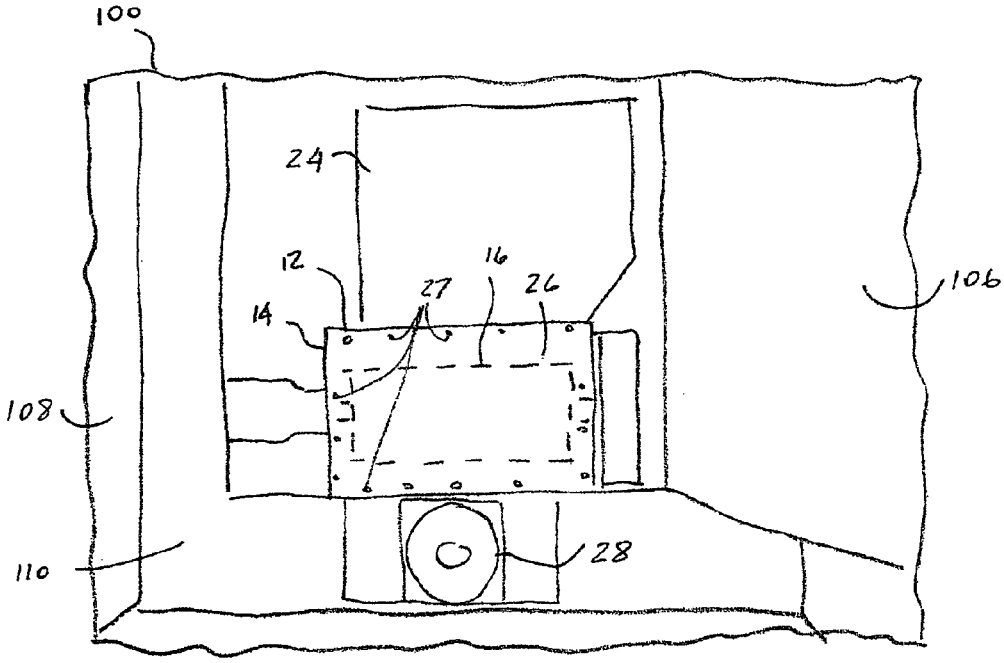
FIG. 10 is a rear view showing the material destruction apparatus, such as the material grinder of FIG. 1, employed within the mobile material destruction system of FIG. 9.

Use of the screen means 30 constructed according to the embodiments described supra is particularly advantageous for use on a material grinder 10 which is installed within a vehicle 100 as best shown in FIGS. 9-10. Such application is well known in the art as a mobile grinder.

The material grinder 10 is positioned toward the cab portion 102 of the vehicle 100 and is accessible trough a pair of opposed side doors 104. The material grinder 10 is further accessible through the door 106 which is mounted within the front wall 110 of the storage compartment 108 employed for storing destructed material. In FIG. 10, such door 106, which is shown as being in an open position, exposes the input chamber 24 of the material grinder 10.

A protective screen cover 26 is attached by way of fasteners 27 to the housing 12 below the input chamber 24 and above a discharge shoot 28 of the material grinder 10. It will be understood that the effort associated with removal and reattachment of such protective screen cover 26 during screen changeover increases the downtime of the mobile grinder and therefore increases the material grinding costs.

Figure 8:
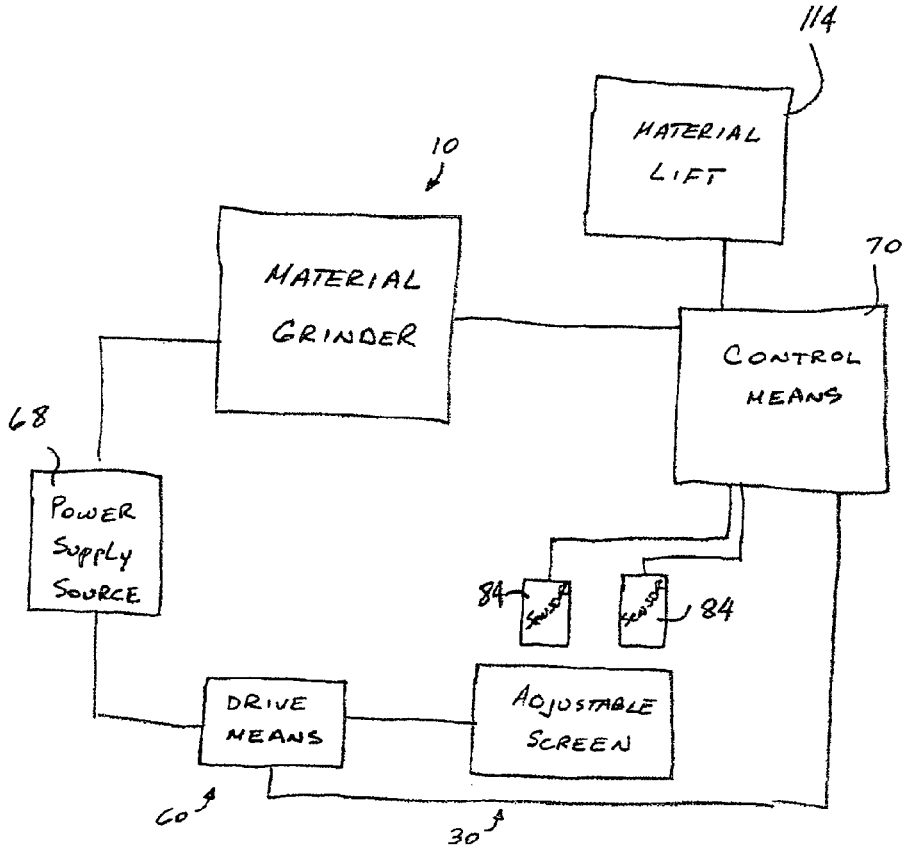
FIG. 8 is a block diagram showing the adjustable screen of the present invention in combination with the material grinder and the control means of the present invention.

The adjustable screen means 30 of the present invention alleviates the downtime problems associated with prior art screens by enabling the particle size selection by way of remotely positioned control means 70 and powered drive means 60 thus eliminating the need for actual removal and reattachment of the protective screen cover 26 as well as for change out of the screen. The control means 70 is positioned adjacent a well known material lift 114, which is schematically shown in FIG. 8.

Accordingly, the operator of such mobile grinder is able to remotely adjust the size of screen openings and select the required particle size of the destructed material. The control means 70 may be adapted for controlling operation of the vehicles power plant (not shown) and hydraulic system (not shown) as disclosed in a closely related Provisional Patent Application titled "Control System for Mobile Material Destruction System" being filed concurrently herewith and whose disclosure is incorporated into this document by reference thereto.

Although the present invention has been shown in terms of the mobile grinder, it will be apparent to those skilled in the art, that the present invention of the adjustable screen means may be applied to a hammer mill apparatus which is well known in the art.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. In combination with at least one of a material grinder and a hammer mill having a housing and a material destruction member operatively mounted in such housing, an adjustable screen apparatus comprising:

(a) a first member which is stationary fixed adjacent such material destruction member and between opposed sides of such housing, said first member having a predetermined plurality of first openings which are disposed in a first predetermined pattern;

(b) a second member positioned in an operatively juxtaposed and nesting relationship for a reciprocal movement relative to said first member, said second member having a predetermined plurality of second openings which are disposed in a second predetermined pattern;

(c) a guide means for guiding said reciprocal movement of said second member relative to said first member; and (d) a power operated drive means coupled to a source of power supply and having a linearly moving member thereof attached directly to said second member for reciprocally moving said second member between a first position wherein each of said plurality of said second openings substantially overlaps a respective one of said plurality of said first openings for producing large size particles and a second position wherein said each of said plurality of said second openings partially overlaps each of a pair of adjacently disposed first openings for producing small size particles.

2. The apparatus, according to claim 1, wherein each of said first member and said second member is arcuately shaped and has each of a predetermined length and a predetermined radius.

3. The apparatus, according to claim 1, wherein a shape of said each first opening is a rhombus and wherein a longer diagonal of said rhombus is disposed in a parallel relationship with a direction of movement of said second member.

4. The apparatus, according to claim 1, wherein a shape of said each second opening is a rhombus and wherein a longer diagonal of said rhombus is disposed in a parallel relationship with a direction of said movement of said second member.

5. The apparatus, according to claim 1, wherein said first openings and said second openings are substantially identical.

6. The apparatus, according to claim 1, wherein said first predetermined pattern and said second predetermined pattern are substantially identical.

7. The apparatus, according to claim 1, wherein said guide means includes a pair of guide rails which are positioned adjacent opposed edges of said first member and which are attached thereto in a parallel relationship with each other, a first pair of housings attached to said second member adjacent one edge thereof and a second pair of housings attached to said second member adjacent an opposed edge thereof, wherein each housing encases a respective one of said pair of guide rails for guiding said movement of said second member.

8. The apparatus, according to claim 1, wherein said power operated drive means includes a linear actuator attached to one side of such housing and wherein said linearly movable member is attached to one end of said second member, said one end disposed in a generally vertical plane.

9. The apparatus, according to claim 8, wherein said linear actuator is a hydraulic cylinder.

10. The apparatus, according to claim 1, wherein said power operated drive means includes an actuator attached to said first member adjacent an exterior surface thereof and between opposed ends of said first and second members.

11. The apparatus, according to claim 1, wherein said apparatus further includes a control means coupled to said drive means for selectively operating said drive means to move said second member between said first and said second position.

12. The apparatus, according to claim 11, wherein said control means is positioned remotely from said drive means.

13. The apparatus, according to claim 11, wherein said control means is disposed within a control panel employed for operating such material grinder.

14. A material grinding apparatus comprising;

(a) a housing;

(b) a rotor mounted for rotation adjacent one end of said housing;

(c) a first drive means for rotating said rotor;

(d) an input chamber formed in open communication with a top surface of said housing for receiving material to be ground;

(e) means for biasing said received material toward said rotor;

(f) a screen means which is positioned adjacent said rotor and between opposed sides of such housing, said screen means including a stationary fixed member and a movable member which is disposed in an operatively juxtaposed and nesting relationship for a reciprocal movement relative to said fixed member, each having a predetermined plurality of openings disposed in a predetermined pattern;

(g) a second drive means coupled to a source of power supply and having a linearly moving member thereof attached directly to said movable member for reciprocally moving said movable member between a first position wherein each opening in said movable member substantially overlaps a respective opening in a fixed member for producing large size particles and a second position wherein said each opening in said movable member partially overlaps each of a pair of adjacently disposed openings in said fixed member for producing small size particles; and (h) a control means for operating each of said first drive means, said material biasing means and said second drive means.

15. The apparatus, according to claim 14, wherein said rotor includes a plurality of cutting inserts disposed in a predetermined pattern.

16. The apparatus, according to claim 14, wherein said first drive means includes an electric motor connected to a flywheel with at least one belt.

17. The apparatus, according to claim 14, wherein said second drive means includes a hydraulic cylinder.

18. A mobile material destruction system comprising;

(a) a vehicle having a cab and a storage compartment for storing destructed material;

(b) a material destruction apparatus which is capable of destructing material and for delivering said destructed material into said storage compartment;

(c) a lift apparatus operatively mounted adjacent said material destruction apparatus for delivering a material to be destructed into an input chamber of said material destruction apparatus;

(d) a power operated adjustable screen means for producing different size particles of said destructed material, said screen means having a stationary fixed member and a movable member which is disposed in an operatively juxtaposed and nesting relationship for a reciprocal movement relative to said fixed member, each having a predetermined plurality of openings disposed in a predetermined pattern, said fixed and said movable members being positioned between an opening into said storage compartment and an output portion of said material destruction apparatus, and a drive means coupled to a source of power supply and having a linearly moving member thereof attached directly to said movable member for moving said movable member between a first position wherein each opening in said movable member substantially overlaps a respective opening in a fixed member for producing large size particles and a second position wherein said each opening in said movable member partially overlaps each of a pair of adjacently disposed openings in said fixed member for producing small size particles; and (e) a control means which is mounted remotely from said screen means for selectively operating said drive means to reciprocally move said movable member between said first position and said second position.

19. The system, according to claim 18, wherein said material destruction apparatus includes a rotor mounted for rotation within said output portion and a drive means for rotating said rotor.

20. The system, according to claim 18, wherein said control means includes a touch screen.

21. The apparatus, according to claim 1, wherein a shape of said each of said first and second openings is a rhombus having each corner thereof adapted with a predetermined radius and wherein a longer diagonal of said rhombus is disposed in a parallel relationship with a direction of movement of said second member.

22. In combination with at least one of a material grinder and a hammer mill having a housing and a material destruction member operatively mounted in the housing, an adjustable screen apparatus comprising:

(a) a first member stationary fixed adjacent the material destruction member and between opposed sides of the housing, said first member having a predetermined plurality of first openings disposed in a first predetermined pattern;

(b) a second member positioned in an operatively juxtaposed and nesting relationship for a reciprocal movement relative to said first member, said second member having a predetermined plurality of second openings disposed in a second predetermined pattern;

(c) a pair of guide rails positioned adjacent opposed edges of said first member and attached thereto in a parallel relationship with each other;

(d) a first pair of housings attached to said second member adjacent one edge thereof and a second pair of housings attached to said second member adjacent an opposed edge thereof, wherein each housing encases a respective one of said pair of guide rails for guiding said reciprocal movement of said second member; and (e) a power operated drive means coupled to a source of power supply and to said second member for reciprocally moving said second member between a first position wherein each of said plurality of said second openings substantially overlaps a respective one of said plurality of said first openings for producing large size particles and a second position wherein said each of said plurality of said second openings partially overlaps each of a pair of adjacently disposed first openings for producing small size particles.

23. In combination with at least one of a material grinder and a hammer mill having a housing and a material destruction member operatively mounted in such housing, an adjustable screen apparatus comprising:

(a) a first member which is stationary fixed adjacent such material destruction member and between opposed sides of such housing, said first member having a predetermined plurality of first openings which are disposed in a first predetermined pattern;

(b) a second member positioned in an operatively juxtaposed and nesting relationship for a reciprocal movement relative to said first member, said second member having a predetermined plurality of second openings which are disposed in a second predetermined pattern;

(c) a guide means for guiding said reciprocal movement of said second member relative to said first member; and (d) a power operated actuator coupled to a source of power supply, said power operated actuator attached to said first member adjacent an exterior surface thereof and between opposed ends of said first and second members, said power operated actuator having a linearly moving member thereof attached directly to an end of said second member for reciprocally moving said second member between a first position wherein each of said plurality of said second openings substantially overlaps a respective one of said plurality of said first openings for producing large size particles and a second position wherein said each of said plurality of said second openings partially overlaps each of a pair of adjacently disposed first openings for producing small size particles.

* * * * *